US008347682B2

(12) United States Patent
Gramer et al.

(10) Patent No.: US 8,347,682 B2
(45) Date of Patent: Jan. 8, 2013

(54) APPARATUS FOR CLEANING CYLINDERS OR ROLLS

(75) Inventors: Andreas Gramer, Solingen (DE); Peter De Kock, Oberhausen (DE); Rolf Brisberger, Spielberg (AT)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 0 days.

(21) Appl. No.: 12/800,897

(22) Filed: May 24, 2010

(65) Prior Publication Data

US 2010/0307546 A1 Dec. 9, 2010

Related U.S. Application Data

(62) Division of application No. 11/664,901, filed on Apr. 5, 2007, now abandoned.

(30) Foreign Application Priority Data

Oct. 6, 2004 (DE) ..... 10 2004 487 619

(51) Int. Cl.
*B08B 3/00* (2006.01)

(52) U.S. Cl. ..... 72/39; 72/40; 134/137; 134/151; 134/198

(58) Field of Classification Search ..... 72/39, 43, 72/200, 201, 236; 134/18, 32, 34, 42, 116, 134/140, 149, 151, 137, 198
See application file for complete search history.

(56) References Cited

U.S. PATENT DOCUMENTS

| | | | | |
|---|---|---|---|---|
| 4,932,232 | A * | 6/1990 | Ballyns et al. | 72/201 |
| 5,460,023 | A * | 10/1995 | Ginzburg | 72/43 |
| 6,557,470 | B1 * | 5/2003 | Persson | 101/424 |
| 2001/0027672 | A1 * | 10/2001 | Barten | 72/201 |
| 2004/0035540 | A1 * | 2/2004 | Menp et al. | 162/199 |

* cited by examiner

*Primary Examiner* — Michael Barr
*Assistant Examiner* — Benjamin L Osterhout
(74) *Attorney, Agent, or Firm* — Abelman, Frayne & Schwab

(57) ABSTRACT

An apparatus for cleaning cylinders (5) and/or rolls (5), e.g., working rolls (5) in a rolling stand, which are used for producing a rolled stock (1) such as strips or slabs, in which a liquid is sprayed onto the cylinders (5) at high pressure through several nozzles D1-Dn, a number of nozzles (D1-Dn) are stationary arranged in and/or on a nozzle beam (10), at least one on-off valve is associated with each nozzle (D1-Dn), and one or several nozzle(s) (D1-Dn) are sequentially switched on and off one after another starting from one end of the nozzle beam.

4 Claims, 4 Drawing Sheets

APPARATUS FOR CLEANING CYLINDERS OR ROLLS

RELATED APPLICATIONS

This application is a divisional of application Ser. No. 11/664,901 filed Apr. 5, 2007 now abandoned.

BACKGROUND OF THE INVENTION

1. Field of the Invention

The invention relates to an apparatus for cleaning cylinders and/or rolls, e.g., working rolls in a rolling stand, which are used for producing a rolled stock such as strips or slabs, wherein a liquid is sprayed onto the cylinders at high pressure through several nozzles.

2. Description of the Prior Art

Cylinder and/or rolls are used in numerous locations of a plant. Their surfaces become dirty and should be cleaned periodically or continuously.

Cleaning of rolling mill rolls with fluid sprayed at high pressure is known. JP-05 069 028A, JP-06 344 005A, JP-10 058 002A, JP-6 285 516, JP-09 262 607A, JP-08 155 509A, JP-08 174 005A, JP-07 068 301A, JP-05 042 309A, JP-05 317 907, JP-05 337 52A, and JP-58 199 604A, show corresponding installations.

EP 0385 097 A2 discloses that in rolling mill technology, wet skin-pass rolling is known, wherein with water or water-like additives, a sliding film is formed between working rolls and backup rolls. Simultaneously, the rolls should be kept clean.

U.S. Pat. No. 5,460,023 describes a method of and an apparatus for cleaning of rolls with a multiplicity of nozzles arranged on a nozzle beam. For a better cleaning of the entire surface of a roll, the nozzle beam is displaced axially. Thereby, each separate nozzle travels a predetermined path over the surface of a roll. Axial displacement of the nozzle beam is effected with a hydraulic cylinder.

EP 09 95 504 B1 discloses a method of cleaning cylinders and/or rolls in strip casting installations, rolling mills, and/or strip treating lines, in particular, skin-pass mills or similar after-treatment mills for producing or treatment of metal strips, according to which cylinders and/or rolls are subjected to cleaning fluid from at least one cleaning nozzle the distance of which from the cylinder surface or the roll surface of the concerned cylinder or roll is adjusted or controlled to a predetermined value, with the cleaning nozzle reciprocating with adjusted or controlled oscillating speed along the concerned cylinder and/or roll dependent on the strip speed and/or strip material and/or strip surface.

In known installations, one or several nozzles are displaced along the cylinder. Therefore, the nozzle or nozzles are arranged, e.g., on a traveling drive unit with slides, wherein each nozzle must be supplied with cleaning fluid by a displaceable supply- or feeding conduit. Further, a movable cabling is necessary. The regulation of the oscillating speed is expensive, as of the distance of nozzles from to-be-cleaned rolls.

Accordingly, an object of the invention is an apparatus for cleaning cylinders/rolls which simpler in operation and design, with increased cleaning effect and prevention of surfaces damages.

SUMMARY OF THE INVENTION

This object is achieved according to the invention, by providing an apparatus of the above-described type in which at least one valve associated with each nozzle.

The decisive advantage of the inventive apparatus consists in that no mechanical movement in the roll longitudinal direction takes place and, therefore, no cable towing apparatus to supply conduits is needed. The electricity necessary for turning on and off the nozzle beam and switching on and off separate nozzles is reduced. During cleaning operation, the 100% of the circumference of the cylinder, or the roll is treated during a cleaning period, so that no dirty spirals appear.

Each cleaning period starts at the same cylinder or roll end, and the intervals between the cleaning periods are the same.

With a rotational angle of the nozzle of 17° and a circumference corresponding to the diameter of 60 mm, the necessary distance to the roll surface amounts to about 200 mm. If an effective diameter of 50 mm is used, with a maximum strip width of 2,100 mm, 42 nozzles are provided per nozzle beam. With a simultaneous activation of two nozzles with a single valve, 21 valves are required. In a preferred embodiment, the nozzles can be arranged with an offset. At a VE-water consumption of 1/min per nozzle and a sequential control of respective two by two nozzles above the rolling stock and two by two nozzles beneath the rolling stock, the total volumetric flow amounts to about 90 l/min.

A cleaning period is determined by two revolution of the cylinder/roll per each nozzle pair, so that the nozzles (n) in the nozzle beam clean the cylinder roller at a second revolution and then are returned off, and the nozzles (n+1) start cleaning of the cylinder/roll during a first revolution. When the nozzles (n) are turned off, the nozzles (n+2) are turned on.

E.g., with a working roll diameter of 620 mm, the length of the rolling stock per nozzle sequence is about 4 m, at a diameter of 560 mm, 3.5 m, and at a diameter of 400 mm, about 3 m. At average roll speed of 100 m/min in a skin-pass stand, the operational period is about 2 sec/nozzle pair and for the entire roll 21 +1 sec/roll. The total length of the rolled stock during cleaning is about 37 m.

BRIEF DESCRIPTION OF THE DRAWINGS

Embodiments of the invention will be now described in detail with reference to schematic drawings.

The drawings show.

DETAILED DESCRIPTION OF THE PREFERRED EMBODIMENT

Figure 1:
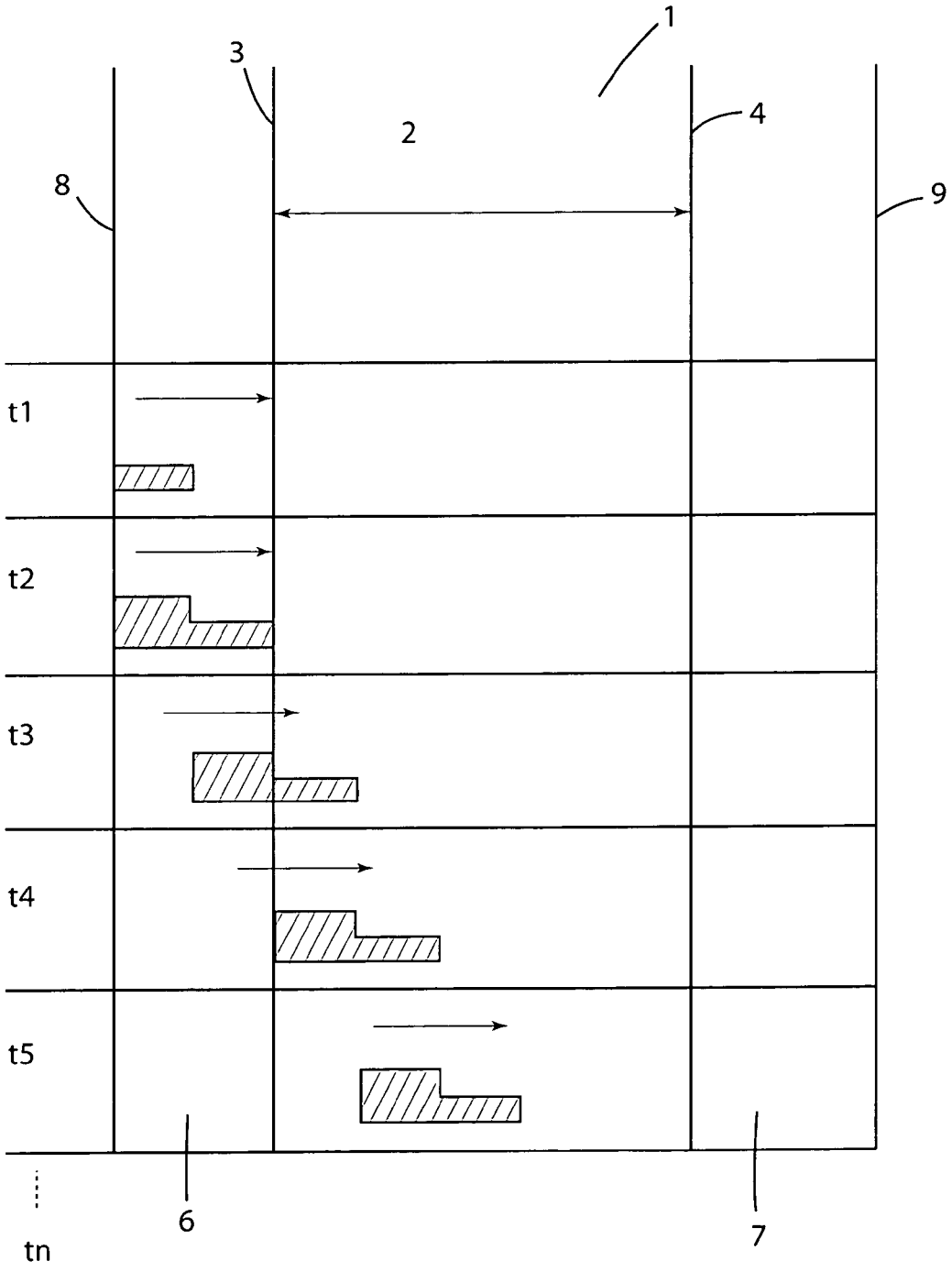
FIG. 1 a timed course of the nozzle discharge.

FIG. 1 shows a timed course of nozzle discharge during cleaning of a cylinder/roll.

A rolled stock, e.g., a metal strip, with a width 2 has a left edge 3 and a right edge 4. A working roll 5 (see FIG. 2) has a length that is greater than a width of the metal strip so that the collar regions 6, 7 of the working roll have no contact with the metal strip 1. The working roll 5 has a left barrel border 8 and a right barrel border 9.

In the shown embodiment, firstly, a left nozzle D1 of the nozzle beam 10 (see (FIG. 2) opens at time t1. After a predetermined time period, at time t2, additionally, a nozzle D2, which is located rightwardly adjacent to the nozzle D1, opens.

After a subsequent time period, at a time t3, the nozzle D1 is turned off, and the next following nozzle D3 opens. This process is repeated as long until the right barrel border 9 of the working roll 5 is reached. The next cleaning period can then follow immediately thereafter when the nozzle D1 opens and then the nozzle 2.

Dependent on the degree of contamination of the cylinders/rolls 5, the next cleaning period follows with a time delay. The delay can follow automatically and have the same time period. It is also contemplated to start the cleaning periods additionally or always manually.

Figure 2:
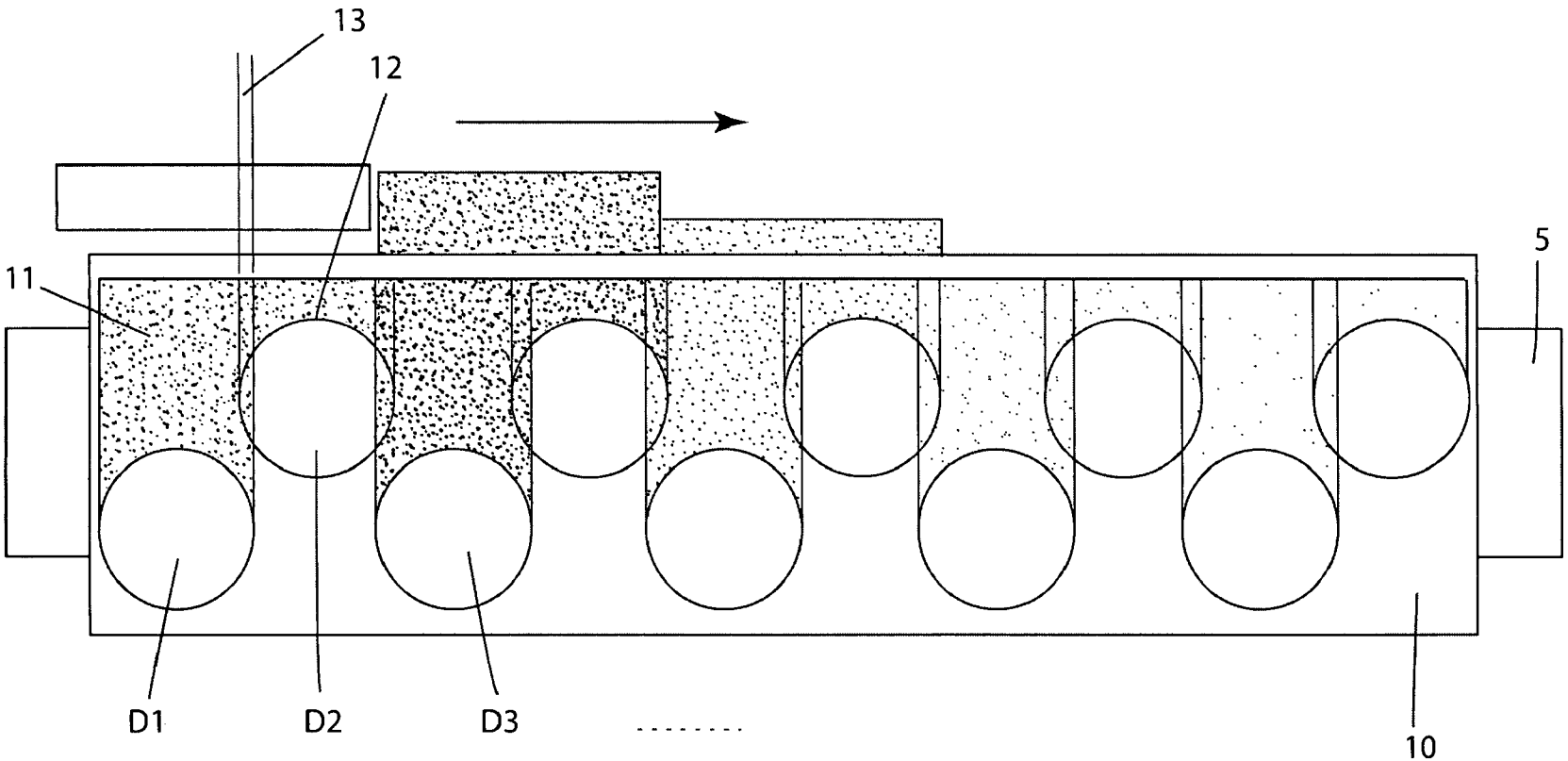
FIG. 2 a view of a spray picture.
Figure 3A:
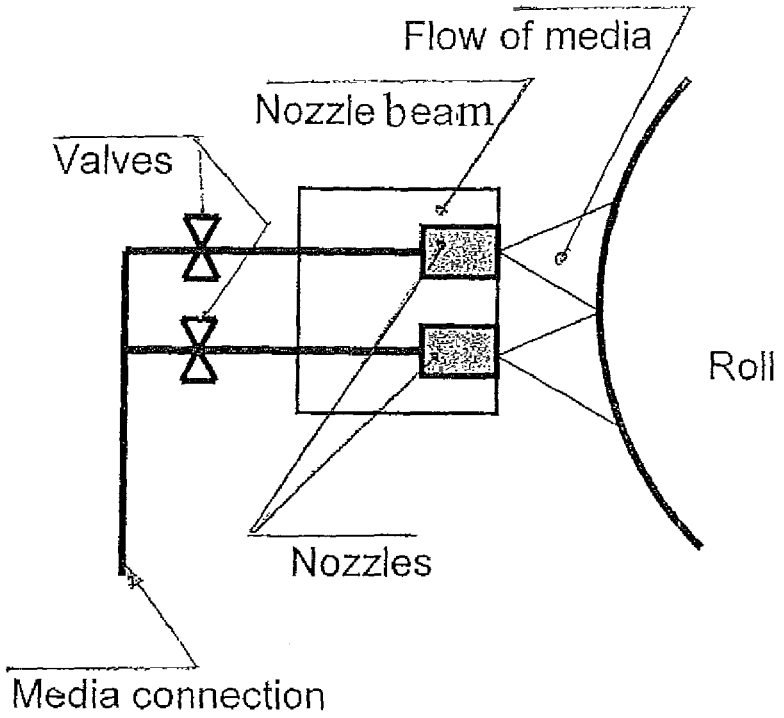
FIG. 3*a* a schematic view of an arrangement in which a single valve controls a single nozzle, FIG. 3*b* a schematic view of an arrangement wherein a single valve controls two nozzles, and FIG. 4 a schematic view illustrating the apparatus according to the present invention in which each of the plurality of valve controls two adjacent nozzles.
Figure 3B:
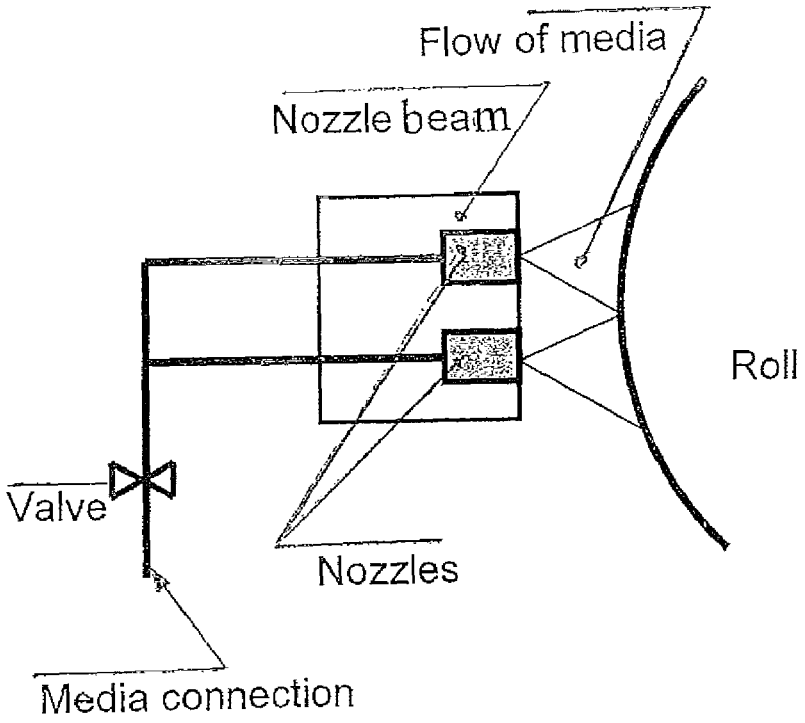

FIG. 2 shows a nozzle beam 10 with ten nozzles (D1-D10). The spray picture 11 of the nozzle D1 overlaps the spray picture 12 of the nozzle D2 in a region 13. The following nozzles show the same overlap. To better form the overlaps, which determine the degree of cleaning of the cylinder/roll, the adjacent nozzles D1, D2, e.g., are arranged on the nozzle beam 10 with offset. Each nozzle D1 or each nozzle pair D1, D2, are controlled by a valve (not shown) as shown in FIGS. 3*a*, 3*b*, respectively.

Figure 4:
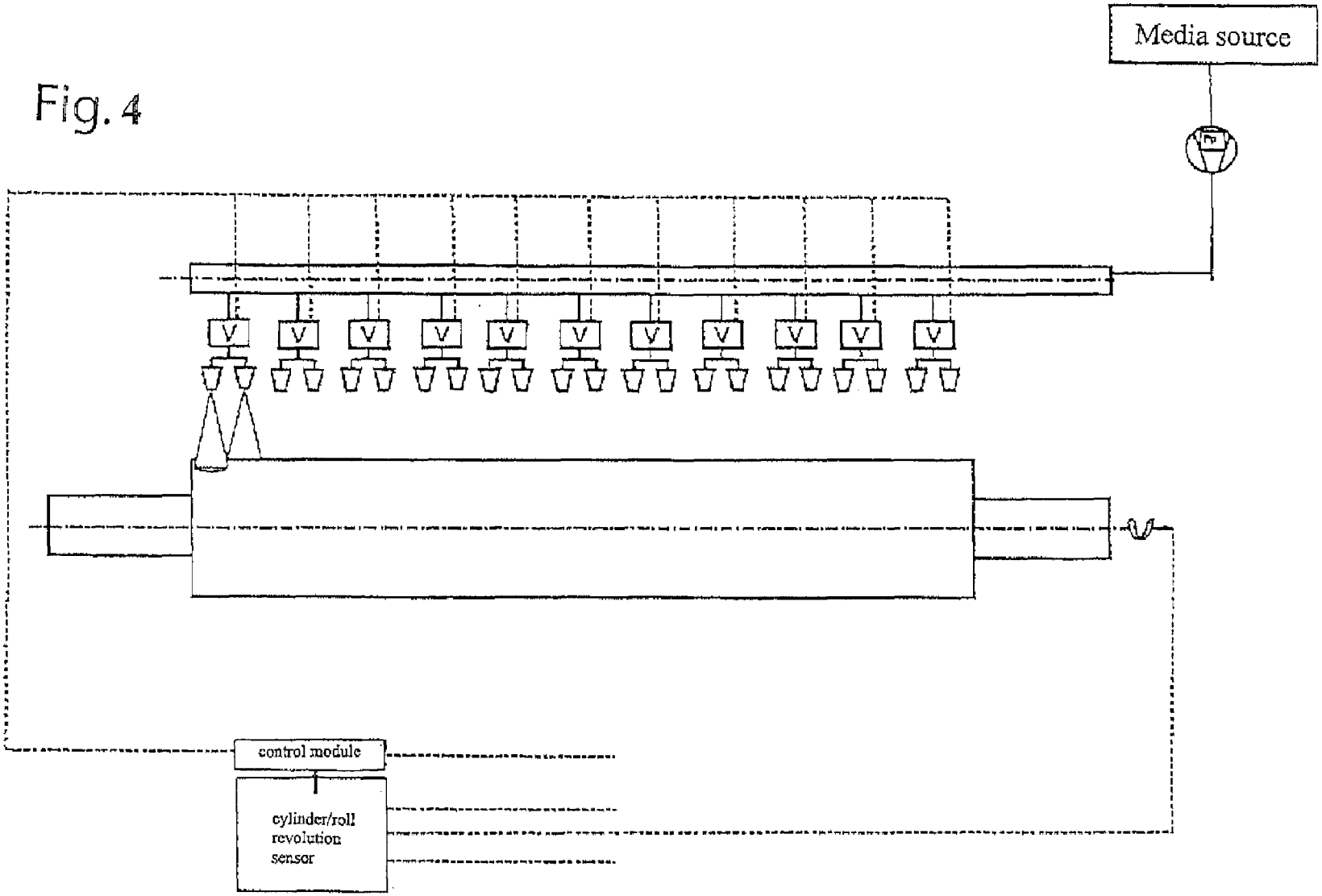

FIG. 4 illustrates the inventive apparatus in which each adjacent pair of nozzles is controlled by a single valve, with the actuation of the valves being effected by a control module in accordance with revolutions of the roll.

What is claimed is:

1. An apparatus for cleaning working rolls in a rolling stand for producing a rolling stock during production of the rolling stock, the apparatus comprising a nozzle-beam extending in a longitudinal direction of a cleanable roll; a plurality of nozzles for spraying liquid under pressure onto the rolls, arranged in two, adjacent to each other, parallel rows extending in a longitudinal direction of the cleanable roll, and supported on the nozzle beam, with nozzles of one row being offset with respect to adjacent nozzles of another row in the longitudinal direction of the cleanable roll, whereby a cleaning effect is increased due to overlapping of nozzle spray patterns; and a plurality of valves associated with respective nozzles for feeding the liquid under pressure thereto.

2. An apparatus according to claim 1, wherein a respective single valve of the plurality of valves controls flow of liquid to a respective pair of nozzles formed by two adjacent nozzles located in respective rows.

3. An apparatus according to claim 1 wherein the nozzle beam has a greater length than the cleanable roll.

4. An apparatus according to claim 1, wherein the plurality of valves comprises a number of valves that corresponds to a number of nozzles in both rows, so that each valve controls a single nozzle.

* * * * *